US005487294A

United States Patent [19]

Petersen

[11] Patent Number: 5,487,294

[45] Date of Patent: Jan. 30, 1996

[54] SYSTEM FOR FORMING END FLANGES ON PIPES

[75] Inventor: Horst U. Petersen, Kitchener, Canada

[73] Assignee: Bend All Manufacturing Inc., Ayr, Canada

[21] Appl. No.: 265,119

[22] Filed: Jun. 24, 1994

[51] Int. Cl.[6] ..... B21D 19/08

[52] U.S. Cl. ..... 72/370; 72/306; 72/318

[58] Field of Search ..... 72/318, 317, 306, 72/316, 356, 357, 370; 29/890.14

[56] References Cited

U.S. PATENT DOCUMENTS

| | | | |
|---|---|---|---|
| 1,467,264 | 9/1923 | Breeze | 72/370 |
| 1,791,887 | 2/1931 | Davies | 72/318 |
| 2,120,067 | 6/1938 | Gray | 29/890.14 |
| 3,052,279 | 9/1962 | Collin | 72/317 |
| 4,980,961 | 1/1991 | Caudill | 72/316 |

FOREIGN PATENT DOCUMENTS

| | | | |
|---|---|---|---|
| 144827 | 6/1988 | Japan | 72/306 |
| 867468 | 9/1981 | U.S.S.R. | 72/316 |
| 363574 | 12/1931 | United Kingdom | 72/370 |

*Primary Examiner*—Daniel C. Crane
*Attorney, Agent, or Firm*—Anthony Asquith & Co.

[57] ABSTRACT

The system increases the diameter to which pipe flanges can be flared. The tendency of the radial wall of the flange to crumple inwards is obviated by coining the transition corner of the wall. First, the pipe end is belled out to provide access for the coining punch. The belled-out end is then swaged back in, after the punch is removed. With the corner transition thus preconditioned, further axial pressure on the pipe with a suitable female punch causes the flange to expand diametrally in a controllable manner.

8 Claims, 3 Drawing Sheets

SYSTEM FOR FORMING END FLANGES ON PIPES

This invention relates to the formation of a flange on the end of a length of metal pipe.

BACKGROUND TO THE INVENTION

Enlarged end flanges are commonly provided on the ends of fluid-conveying pipes for the purpose of enabling the pipe to be sealed with respect to, and to be secured mechanically to, a fitting in a pump, valve, or other fluid circuit element. Conventionally, a pipe-nut fits loosely over the pipe, and engages a screw-thread formed in the circuit element, whereby the flange on the pipe may be drawn tightly into the fitting.

In the case where the enlarged end flange on a pipe involves only a slight change in diameter, the conventional manner of providing the flange is to flare the end of the pipe. In flaring, the pipe is gripped or clamped radially, and a tool is inserted axially into the end of the pipe. Pressing the tool into the pipe serves to cause an enlargement of the end of the pipe. That the thrust is axially-directed is a characteristic of flaring. When only a slight swelling is called for, the flaring can be made with quite crude tools and processes.

One of the difficulties in flaring the end of a pipe arises when large changes in diameter are called for. As the diametral change becomes larger, it becomes increasingly difficult to control the bending and distortion of the flange, by means of the axially moving punch or tool. The designer knows that if he calls for too much of a diamteral change, the metal of the pipe wall tends to pucker, crumple, and otherwise take on unwanted deformations. The material may even crack or split.

Accordingly, when large changes of diameter have been required, it has hitherto usually been the case that a separate component is manufactured, and the separate component is then secured, by brazing or soldering for example, to the end of the pipe. Whilst the use of a separate component releases the designer from many constraints, of course the separate component adds greatly to the expense of the finished pipe.

It is an aim of the invention to provide an enlarged flange on the end of a pipe, in which the diametral enlargement is greater than has hitherto been considered safe, and yet in which that large degree of diametral enlargement is controllable, and does not lead to spurious deformations of the pipe material.

THE BASIC FEATURES OF THE INVENTION

In producing a large diameter flange, an end of the pipe is clamped between the jaws of a die, in the usual way, and a punch is pressed into the exposed end of the pipe. In the preferred form of the invention, a punch with a nose is inserted into the end of the pipe, the nose being nominally the same size as the interior diameter of the pipe. The punch is formed with a shoulder, whereby, when the punch is driven into the pipe end, the material of the pipe flows around the shoulder, thus causing the pipe to expand, i.e. to bell out. The punch is driven into the pipe end until the travel of the punch into the pipe end is blocked by the presence of the die. At this point, in the invention, the punch is given a final forceful thrust, which coins the thickness of the material between the punch and the die.

It is arranged, in the invention, that the corner transition of the pipe end, where the material just starts to swell into the belled-out formation, is the portion of the pipe material that takes the force of the coining thrust. As a result, the inside and outside surfaces of the pipe, at this critical corner, are coined into close conformity with the corresponding corner transitions present on the punch and die.

As will be explained, this pre-conditioning of the corner transition is very important in constraining the material later to flow in the desired manner around the die. After the punch has been withdrawn, as will be described, the material of the pipe end is swaged into the required diametral reductions and expansions.

THE PRIOR ART

Flaring or flanging the ends of pipes is well known technology, for the purposes as described above. A typical example is shown in U.S. Pat. No. 1817854 (SORENSEN, Aug. 1931) in which a pipe end is expanded into a die cavity by means of an axially-directed press-force. U.S. Pat. No. 3263476 (HINDERER, Aug. 1966) is another example.

DETAILED DESCRIPTION OF PREFERRED EMBODIMENT

By way of further explanation of the invention, exemplary embodiments of the invention will now be described with reference to the accompanying drawings, in which.

The systems and apparatus shown in the accompanying drawings and described below are examples Which embody the invention. It should be noted that the scope of the invention is defined by the accompanying claims, and not necessarily by specific features of exemplary embodiments.

Figure 1:
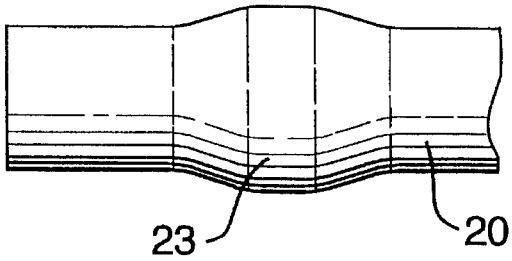
FIG. 1 is a side elevational view of the end of a pipe, in which a swelled form has been applied, this drawing illustrating the type of end form which could readily be applied using conventional systems.

In FIG. 1, there is shown a pipe 20 with an enlarged end form 23. The form 23 amounts to no more than a swelling, of a relatively small diametral distortion. Flanges or forms of this kind can be readily produced using simple conventional in-line flaring or axial press techniques.

For the operation of applying the end form to the pipe 20, the pipe is gripped by means of opposed jaw-clamps (not shown in FIG. 1) which are pressed together across a diameter of the pipe, and which hold the pipe fast during pressing. A bolster rod (not shown) may be placed inside the pipe during pressing, to prevent any inwards deformation of the pipe material, but often there is little tendency to such inwards deformation. The system shown in the SORENSEN patent is highly suitable for producing such end forms as that shown in FIG. 1.

Figure 2:
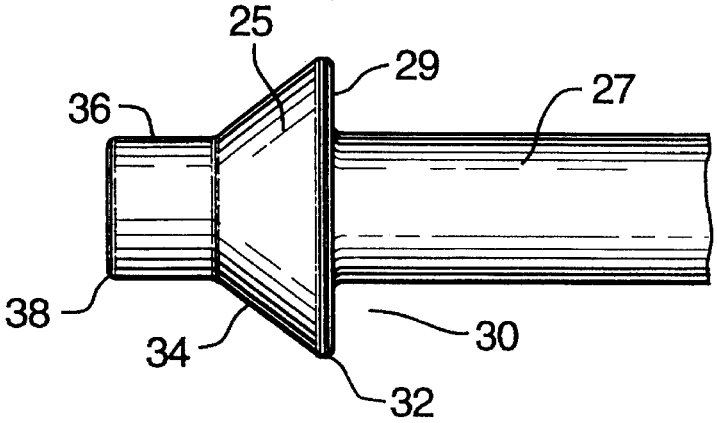
FIG. 2 is a view corresponding to FIG. 1 of a pipe on which has been applied an enlarged flange of the type that was extremely difficult to produce using conventional systems, but which can be readily produced using the system of the invention.

FIG. 2 shows a much more demanding enlarged end formation, in the form of a flange 25 formed on a pipe 27. The flange 25 includes a back wall 29; a corner 30 between the wall 29 and the main length of the pipe 27; an outer diameter 32, front wall 34; a nose 36; and a chamfer 38 at the very end of the nose 36. The back wall 29 is flat and straight and extends at right angles to the axis of the pipe 27, while the front wall 34 slopes at a more or less gentle angle, as shown.

If such an enlarged flange as that shown in FIG. 2 were attempted using a conventional system such as that shown, for example, in SORENSEN, the main problem would be that the back wall 29 of the flange would be puckered and fluted, and would be bowed or bulged inwards. The material might even crack or split. It is very difficult, using conventional systems, to produce a back wall which is flat and straight.

The greater the difference between the nominal pipe diameter and the outer diameter 32 of the flange, the more difficult it is to produce a back wall 29 that is flat and straight over its whole radial extent.

Figure 3:
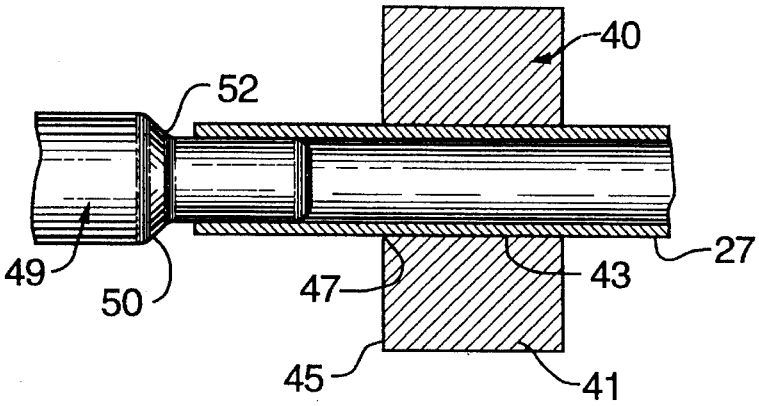
FIG. 3 is a side elevational view, shown in cross-section, of a pipe, the end of which is undergoing a first stage of treatment in the system of the invention.

The system for producing the flange 25 is shown in FIGS. 3–9. In FIG. 3, the pipe 27 is inserted into a suitable press, and is gripped therein in a die 40, which comprises two jaws 41. The jaws 41 clamp radially onto the outside of the pipe. These jaws lock the pipe to the machine during processing and treatment. The inside surfaces 43 of the die 40, which lie in direct contact with the material of the pipe 27, are suitably formed to avoid marking or damaging the pipe.

The forward-facing surface 45 of the die 40 will receive the back wall 29 of the flange, and is suitably smooth and flat. The transition 47 between the inside surface 43 and the forward-facing surface of the die, which will receive the corner 30, is formed with a carefully controlled radius: the transition 47 is not sharp, though the radius is small. The jaws thus constitute a female die or form tool, and the jaws are of suitably hardened steel.

A male punch 49 of the press is rammed in the axial direction into the pipe 27. A shoulder 50 on the punch 49 causes the material of the pipe to flow around the shoulder, and to increase in diameter.

Figure 4:
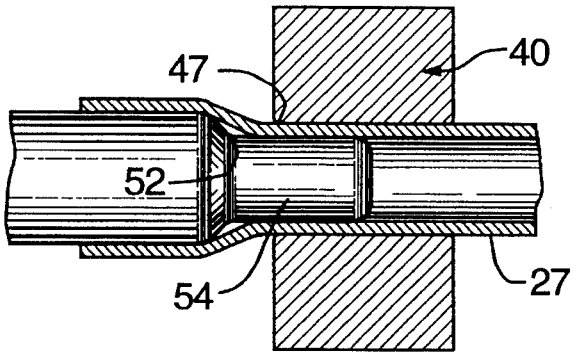
FIG. 4 is a view corresponding to FIG. 3, showing a second stage of treatment.

It will be understood that, because the material of the pipe 27 is being forced outwards, at the FIG. 4 stage the material is either clear of the transition 52 between the shoulder 50 and a nose 54 of the punch 49, or, if the material is indeed touching the transition 52, it is touching it only very lightly.

Figure 5:
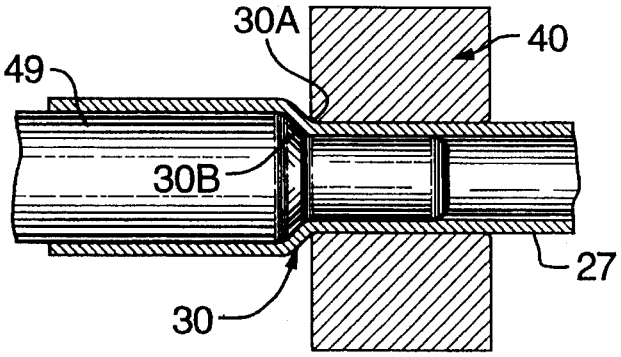
FIG. 5 is a view corresponding to FIG. 3, showing a third stage of treatment.
Figure 7:
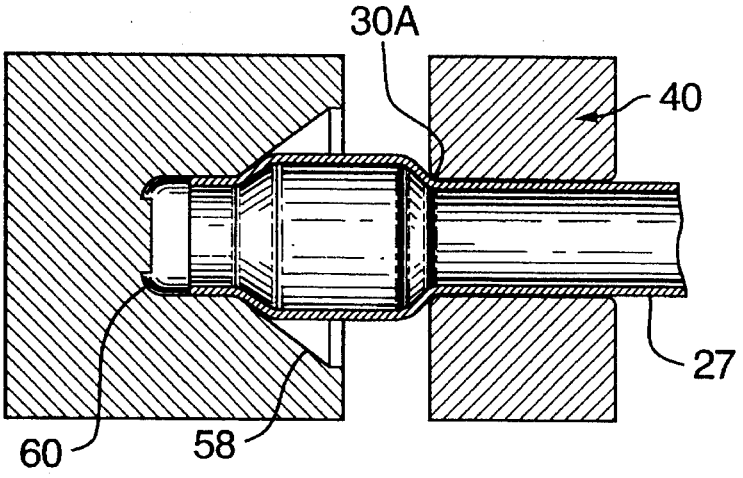
FIG. 7 is a view corresponding to FIG. 3, showing a fourth stage of treatment.

FIG. 5 shows the condition when the punch 49 arrives at the end of its travel relative to the die 40. The important area is the bend of the material at the corner 30. Numeral 30A is the point on the outside surface of the wall of the pipe at the corner 30, and numeral 30B is the zone on the inside surface of the wall of the pipe. The transition 47 in the die lies in contact with the point 30A, whilst the transition 52 in the punch lies in contact with the zone 30B.

The dimensions and travel adjustments of the press are so arranged that the thickness of the pipe material at the corner 30 is trapped between the die transition 47 and the punch transition 52. The die transition 47 is in heavy forceful contact with the point 30A, and the punch transition 52 lies in heavy forceful contact with the zone 30B.

As such, the corner 30 of material is treated to a coining operation, in that the material is not just bent, but rather the bulk of the material is squeezed and compressed. The pressure required from the press to carry out a coining of the corner is larger than that required simply to cause the pipe to expand, as in FIG. 3, and the designer must see to it that the press has sufficient capacity to carry out the coining action.

The coining of the corner 30 pre-conditions the point 30A on the outer wall of the pipe, but more importantly coining the corner pre-conditions the zone 30B on the inside of the pipe. It is this preparation or pre-conditioning of the corner 30, from inside the pipe, that is the key to trouble-free production of the flange and especially of the back wall 29.

Figure 6:
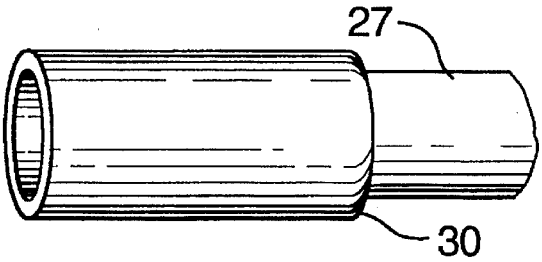
FIG. 6 is a pictorial view of the end of the pipe after treatment to the stage shown in FIG. 5.

After the punch 49 has completed its travel into the pipe, the punch is withdrawn from the pipe, and FIG. 6 shows the condition of the pipe at this point. (In fact, of course, the pipe remains clamped in the die 40 throughout manufacture of the flange.)

Next, the press is manipulated to bring a female punch 56 into line with the axis of the pipe 27. The female punch is forced into the belled-out pipe end (FIG. 7) and the tip of the pipe contacts the sloping face 58 of the punch 56. As the punch continues to the right, the belled-out end of the pipe is swaged in, or reduced in diameter, and in fact the end is swaged in until the diameter of the swaged-in nose 36 of the pipe end is more or less the same diameter as the main length of the pipe 27.

Figure 8:
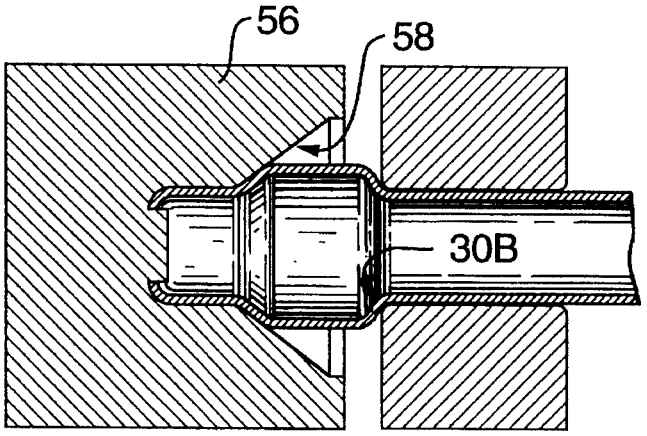
FIG. 8 is a view corresponding to FIG. 3, showing a fifth stage of treatment.
Figure 9:
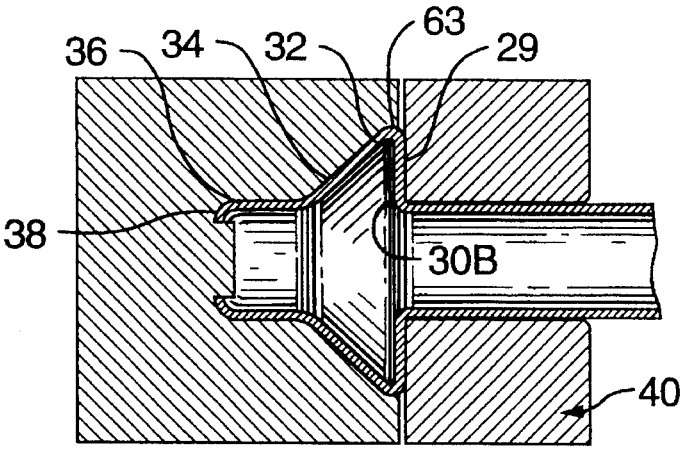
FIG. 9 is a view corresponding to FIG. 3, showing a final stage of treatment, in which the end flange on the pipe is the same as that shown in FIG. 2.

The swaging-in of the pipe end continues until the tip of the nose 36 reaches the end of the recess 60 in the punch 56. The recess is formed with an inward radius or chamfer, as shown. (The nose 36 of the pipe, in use, will enter and engage an O-ring seal, and the purpose of the chamfer is to give the nose a lead-in to ease entry into the seal.) Now, the tip of the nose 36 can pass no further into the punch 56 (the condition as shown in FIG. 8). Further travel of the punch causes the material of the pipe to bell outwards, under the constraint of the sloping face 58 of the punch. When the punch 56 finishes its travel, nominally bottoming out on the die 40, the end of the pipe has adopted the shape of flange as shown in FIG. 9. The die and punch are dimensioned so that there is a little extra space in the die, at 63, for the outer diameter 32 of the flange, whereby an edge-of-tolerance pipe can still be accommodated.

It is recognised that one of the reasons for the difficulty, as encountered in conventional systems, in keeping the back wall 29 of the flange flat arises because the zone 30B on the inside of the pipe wall was not pre-conditioned. In the system as described, this zone is conditioned by the coining operation.

Access to the inside of the pipe, in order to carry out this coining operation, is gained by first belling out the end of the pipe (FIG. 4). After the coining of the corner 30 has been carried out inside the belled-out end of the pipe, with the inside zone 30B of the corner 30 now prepared, the end of the pipe can be swaged back down to its original diameter.

Even though, as described, access may be had, for coining, to the inside of the pipe, it is of course the case that at the critical time when the back wall 29 of the flange 25 is being formed there can be no support inside the pipe to constrain the back wall from crumpling inwards. In fact, as will be noted from a reference to FIG. 9, it will be understood that the interior of the flange is like a vast empty cavern, which is virtually completely unsupported on the inside, as compared with the kinds of shape that are normally considered "safe" to be formed by the conventional type of axial-press flaring.

The pre-conditioning of the corner 30 ensures that at least the radially-innermost regions of the back wall 29 start out, in the FIG. 8 condition, smoothly contoured, already almost at the finished profile. The outer point 30A of the corner fits snugly into the transition 47, and it may be regarded that the back wall simply rolls itself progressively up the face 45 of the die. The corner 30 is already made: there is therefore little tendency for a clearance to develop between the point 30A and the transition corner 47 of the die, even though the material is not at this time supported from the inside.

Without the coining operation, the corner 30 would not fit so snugly into the die. Any poorness of fit between the corner 30 and the transition 47 would mean that the corner 30 had started to lose contact with the transition, which in turn would mean that the back wall 29 had started to bulge inwards. Coining the corner, from inside, ensures not only that the inside surface of the pipe wall at the corner is pre-conditioned for the sharp corner, but ensures also that the outside surface of the pipe wall at the corner is ready to tuck itself snugly into the transition in the die. With these conditions prevailing at the corner, the back wall really never has the opportunity to start to bulge inwards, even though the diameter to which the flange is manipulated is so great.

Figure 10:
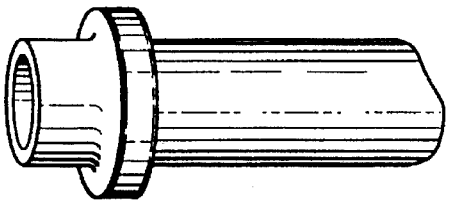
FIG. 10 is a pictorial view of a pipe with another type of end flange that can be readily produced using the system of the invention.

It is recognised that the operation of pre-conditioning the corner from the inside also allows such shapes as that shown in FIG. 10 to be produced by a flaring press, i.e. a press which basically simply applies axially-directed pressure to the end of the pipe.

The main problem in conventional systems, in trying to flare shapes like that of FIG. 2 or FIG. 10, was to get the back wall to lie flat against the die, bearing in mind that when the back wall is being formed there is nothing inside the flange to support the wall against bulging or puckering inwards. It is recognised that pre-coining the corner from the inside is a key factor that allows the flange to be of a large diameter, and at the same time allows the back wall to be flat.

I claim:

1. Procedure for producing an enlarged end-flange on a pipe, being an end-flange which includes front and back radially-extending walls formed in the material of the pipe, the walls being opposed in that the front wall faces towards the end of the pipe and the back wall faces away from the end of the pipe, and which includes an endmost-portion of the end-flange, the endmost-portion being cylindrical and of approximately the same diameter as the nominal diameter of the pipe, wherein:

the end-flange of the pipe is of the type in which, inside the end-flange, the front wall is axially spaced from, and out of contact with, the back wall;

the procedure includes the steps of clamping the pipe in a female die, leaving an end-portion of the pipe protruding from the die, the die having an inner surface complementary to the pipe, having a surface facing the end of the pipe, and having a transition corner therebetween;

belling-out the protruding end-portion of the pipe, creating a transition between the belled end-portion and the portion of the pipe gripped in the female die;

providing a male punch, having a nose, a shoulder of greater diameter than the nominal inside diameter of the pipe, and having a transition corner between the shoulder and the nose;

with the male punch inside the belled end-portion, pushing the male punch far enough axially, that the wall material of the pipe, at the said transition, is coined between the transition corner of the die and the transition corner of the punch;

withdrawing the male punch, leaving the pipe with the whole length of the end-portion belled;

reducing the diameter of a endmost-portion of the belled end-portion, being less than the whole length of the end-portion, leaving an inner-length-portion of the belled end-portion not reduced;

while constraining the length of the endmost-portion against diametral expansion and with the interior of both the endmost-portion and inner-length-portion being unsupported, pushing axially on the pipe to the extent that the inner-length-portion of the end-portion buckles or collapses, and increases in diameter, thereby creating the said front and back walls;

ceasing pushing axially on the pipe before the front wall touches the back wall internally, and while the front and back walls are still internally spaced apart in the axial sense.

2. Procedure of claim 1, wherein the end-flange is of the type in which the back wall of the flange lies in a plane perpendicular to the axis of the pipe, and the front wall is conical.

3. Procedure of claim 1, wherein:

the procedure includes the step of so dimensioning the die and the punch that when the punch is pressed fully home into the belled-out end of the pipe in the die: (a) the nose of the punch is radially spaced from the inside surface of the die by a distance that is substantially equal to the thickness of the material, and (b) the transition corner in the punch lies facing the transition corner in the die, and is so contoured as to lie spaced therefrom by a distance that is substantially equal to the thickness of the material;

whereby, when the punch is pressed fully home into the die the wall material of the pipe is coined between the transition corner in the die and the transition corner in the punch.

4. Procedure of claim 1, wherein the die is in the form of a pair of jaws, and the die includes means for gripping the pipe between the jaws.

5. Procedure of claim 1, wherein the procedure includes the step, after withdrawing the said punch from the pipe, of swaging in an end-most portion of the belled-out end of the pipe, whereby the diameter of the said portion is reduced.

6. Procedure of claim 1, wherein the procedure includes the step:

of providing a female punch, the female punch having a conically-tapered recess, the outer diameter of the recess being larger than the diameter of the belled-out end of the pipe;

and of driving the female punch into the die, over the belled-out end, whereby the pipe expands into the recess.

7. Procedure of claim 6, wherein the shape and dimensions of the female punch are such that the interior of the belled-out end of the pipe stays clear of contact with the female punch, when the female punch is inserted into and retracted from the pipe.

8. Apparatus for producing an enlarged end-flange on a pipe, being an end-flange which includes front and back radially-extending walls formed in the material of the pipe, the walls being opposed in that the front wall faces towards the end of the pipe and the back wall faces away from the end of the pipe, and which includes an endmost-portion of the end-flange, the endmost-portion being cylindrical and of approximately the same diameter as the nominal diameter of the pipe, wherein:

the end-flange of the pipe is of the type in which, inside the end-flange, the front wall is axially spaced from, and out of contact with, the back wall;

the apparatus comprises:

a female die, having a means for clamping the pipe, leaving an end-portion of the pipe protruding from the die, the die having an inner surface complementary to the pipe, having a surface facing the end of the pipe, and having a transition corner therebetween;

an operable means for belling-out the protruding end-portion of the pipe, which is effective to create a transition between the belled end-portion and the portion of the pipe gripped in the female die;

a male punch, having a nose, a shoulder of greater diameter than the nominal inside diameter of the pipe, and having a transition corner between the shoulder and the nose;

an operable means for pushing the male punch, with the male punch inside the belled end-portion, far enough axially that the wall material of the pipe, at the said transition, is coined between the transition corner of the die and the transition corner of the punch;

an operable means for withdrawing the male punch, leaving the pipe with the whole length of the end-portion belled;

an operable means for reducing the diameter of an endmost-portion of the belled end-portion, being less than the whole length of the end-portion, which is effective, when operated, to leave an inner-length-portion of the belled end-portion not reduced;

an operable means for pushing axially on the pipe, which is forceful enough, when operated, and while constraining the length of the endmost-portion against diametral expansion, that the inner-length-portion of the end-portion buckles or collapses, and increases in diameter without support for the interior of both the endmost-portion and the inner-length-portion, thereby creating the said front and back walls;

an operable means for withdrawing the means for pushing axially on the pipe, which is operable before the front wall touches the back wall internally, and while the front and back walls are still internally spaced apart in the axial sense.

* * * * *